US006640473B1

(12) United States Patent
Shenk

(10) Patent No.: US 6,640,473 B1
(45) Date of Patent: Nov. 4, 2003

(54) GREETING CARD WITH DVD

(75) Inventor: Gary Shenk, Universal City, CA (US)

(73) Assignee: Flixmix, Inc., Universal City, CA (US)

( * ) Notice: Subject to any disclaimer, the term of this patent is extended or adjusted under 35 U.S.C. 154(b) by 0 days.

(21) Appl. No.: 10/205,154

(22) Filed: Jul. 25, 2002

(51) Int. Cl.[7] ..... G09F 1/00

(52) U.S. Cl. ..... 40/124.11; 40/594; 283/117; 206/215

(58) Field of Search ..... 40/124.06, 124.09, 40/124.11, 594, 773; 283/117; 206/215

(56) References Cited

U.S. PATENT DOCUMENTS

| | | | | | |
|---|---|---|---|---|---|
| 3,100,047 | A | * | 8/1963 | Wallace | 206/215 |
| 3,430,761 | A | * | 3/1969 | Pelkey | 206/215 |
| 4,200,222 | A | * | 4/1980 | Feuer | 40/124.11 |
| 4,440,298 | A | * | 4/1984 | Knight | 40/124.06 |
| 5,551,730 | A | * | 9/1996 | Barreca et al. | 40/124.11 |
| 5,829,583 | A | * | 11/1998 | VerWeyst et al. | 206/308.1 |
| 5,942,165 | A | * | 8/1999 | Sabatini | 264/1.33 |
| 6,106,023 | A | * | 8/2000 | Sud et al. | 283/117 |

* cited by examiner

*Primary Examiner*—Gary Hoge
(74) *Attorney, Agent, or Firm*—Perkins Coie LLP

(57) ABSTRACT

A greeting card has a first panel and a second panel joined at a fold line. A video disc is removably attached to the first panel. A cutout on the second panel is arranged such that the video disc is visible when the card is closed.

18 Claims, 4 Drawing Sheets

GREETING CARD WITH DVD

BACKGROUND OF THE INVENTION

The field of the invention is greeting, gift and novelty cards. More particularly, the invention is directed to a greeting card including a digital video disc (DVD).

DVDs are generally sold in hard plastic cases with a centrally located post to mount the disc. Typically, a clear plastic cover is provided on the case. Cardboard cases, mailers or envelopes have also been used to store, ship or display DVDs.

Greeting, gift and novelty cards, collectively referred to herein as "greeting cards," have customarily been given or exchanged on holidays, anniversaries, graduations and other occasions to send messages or to commemorate or celebrate special events. Over time, greeting cards have developed to include more than just text, drawings and pictures on the card itself. For example, cards may now include ribbons or pop-up figures. Other cards have included flashing lights or sound devices which play a short melody when the card is opened. Still, greeting cards have not yet been able to provide a quality multi-media experience to the recipient.

Accordingly, it is an object of the invention to provide a greeting card providing a novel experience for the recipient of the card.

SUMMARY OF THE INVENTION

In a first aspect of the invention, a greeting card includes two panels with a DVD removably attached to a first panel. A cutout is optionally provided in the second or front panel as a window to view the DVD. The DVD and cutout may have a variety of shapes and sizes appropriate for the theme of the greeting card. The DVD may optionally at least partially protrude through the cutout. The DVD is preferably a miniature DVD. Themed images are optionally included on the DVD.

In a second aspect of the invention, a greeting card includes a DVD removably attached to a first panel. A second panel, which overlaps the first panel, includes a cutout which provides access to remove the DVD from the first panel when the greeting card is folded close.

In a third aspect of the invention, a greeting card package includes the greeting card of the first aspect and an envelope or mailer packed in a transparent sleeve to protect the greeting card. A message card is preferably enclosed within the sleeve, along with the envelope or mailer.

Accordingly, it is an object of the present invention to provide an improved greeting card. Other and further objects and advantages will appear hereinafter. The invention resides as well in subcombinations of the features described.

BRIEF DESCRIPTION OF THE DRAWINGS

Other objects and features will become apparent from the following detailed description taken in combination with the accompanying drawings. However, the drawings are provided for purpose of illustration only, and are not intended as a definition of the limits of the invention.

In the drawings, wherein the same reference number indicates the same element throughout the several views.

DETAIL DESCRIPTION OF THE DRAWINGS

Figure 1:
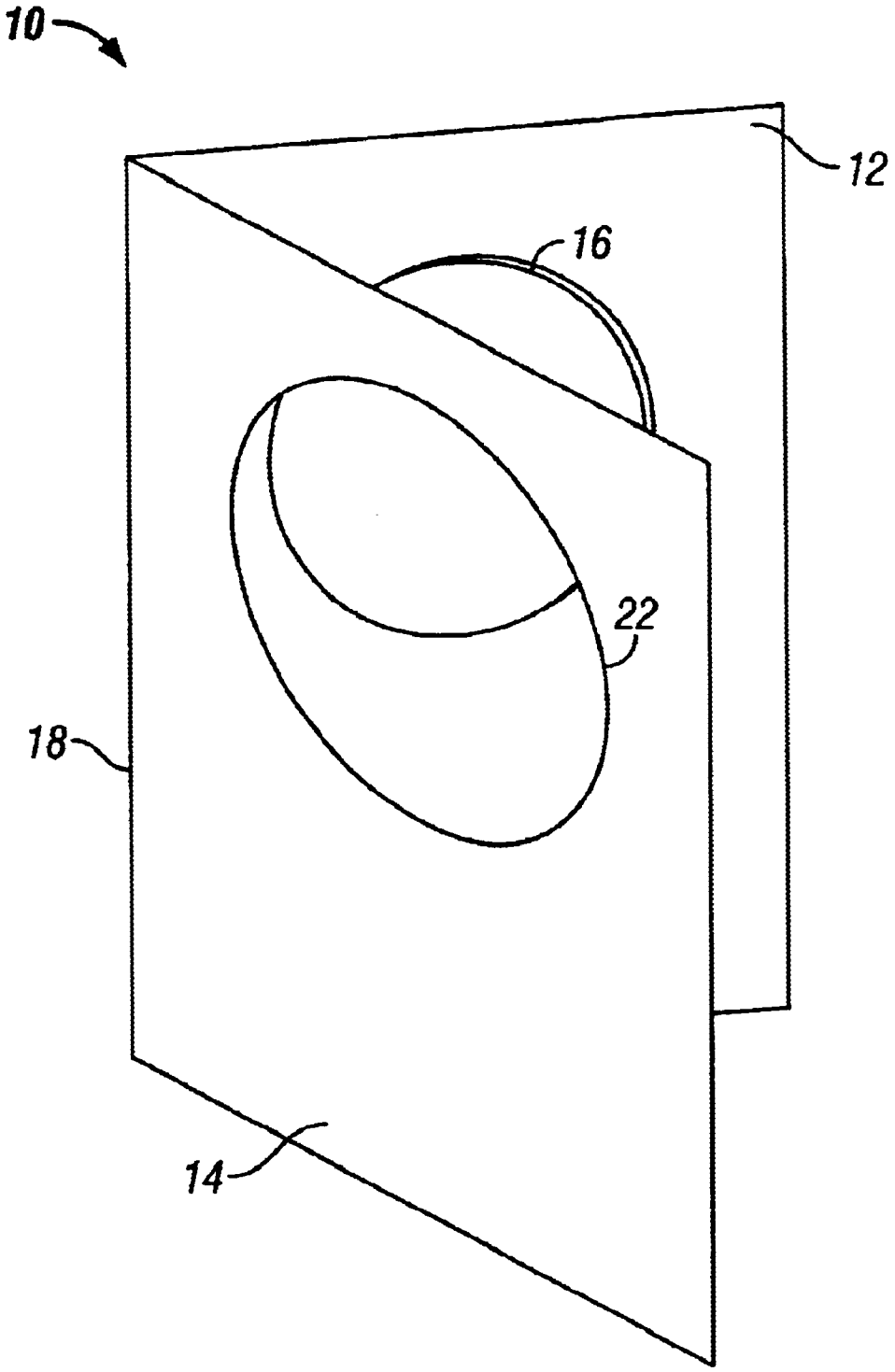
FIG. 1 is a perspective view of the present greeting card.
Figure 2:
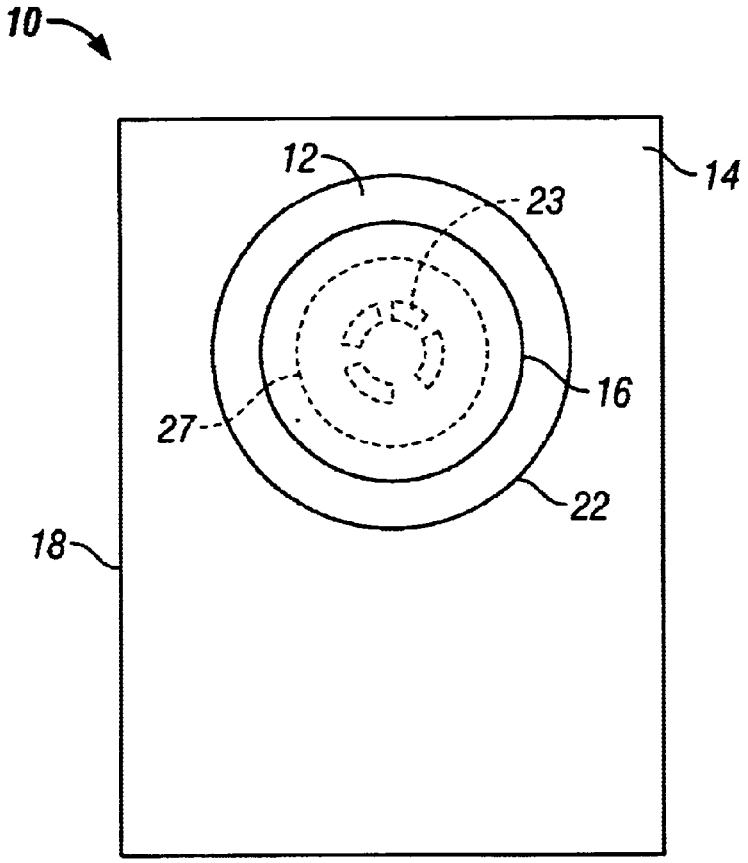
FIG. 2 is a front view of the greeting card of FIG. 1.
Figure 3:
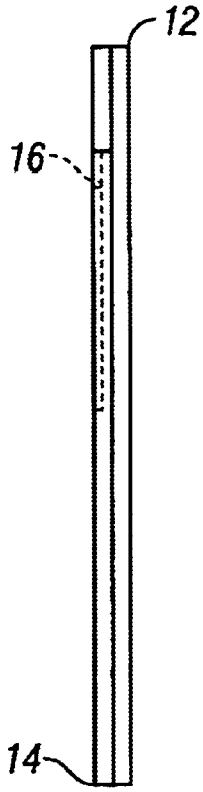
FIG. 3 is a side view of the greeting card of FIG. 1.

Turning now in detail to the drawings, as shown in FIGS. 1–3, the greeting card 10 includes a first or back panel 12, a second or front panel 14 and a DVD 16 attached onto the back panel 12. A seam or fold or hinge line 18 forms a flexible or foldable connection between the first panel 12 and the second panel 14.

The first panel 12 and second panel 14 are preferably made from thick paper, although plastic or other materials may also be used. The first panel 12 and the second panel 14 may be closed, where the panels overlap each other, or open as shown in FIG. 1, where the panels are not overlapped. The first panel 12 and the second panel 14 may have different shapes and sizes. Preferably, however, the panels are the same overall shape and size. In the preferred embodiment, the outer perimeter of each panel is rectangular or square as shown in FIGS. 1 and 2.

The hinge or fold line connecting the first panel 12 and the second panel 14 is advantageously created by folding a single large piece or panel, having a size equaling the combined sizes of the first panel 12 and the second panel 14. Folding the large panel in half creates a common edge along the hinge line 18. Alternatively, the first panel 12 and the second panel 14 may be connected using a binder ring or other suitable attachment or fasteners.

Figure 4:
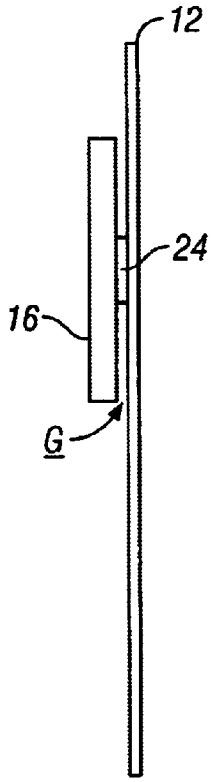
FIG. 4 is a side view of the greeting card of FIG. 1 with the top panel not shown.
Figure 5:
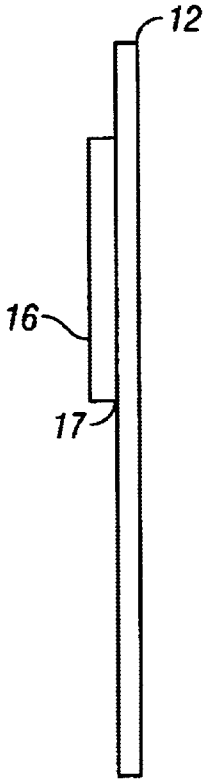
FIG. 5 is a side view of an alternate greeting card with the top panel not shown.

The DVD 16 is removably attached to the first or rear panel 12. An adhesive 17 may be used to temporarily secure the DVD onto the first panel 12 as shown in FIG. 5. However, preferably, an adhesive tab or pad between the first panel 12 and the DVD 16 holds the DVD spaced apart from the first panel 12, by a gap G as shown in FIG. 4. The pad 24 is preferably small compared to the size of the DVD or digital disc 16 and arranged to support the digital disc 16 without contacting any portion of the disc containing recorded information. By elevating the disc 16 from the first panel 12, the pad 24 advantageously reduces the potential of damaging the DVD 16 such as by scratches caused by friction between the DVD 16 and the first panel 12 during handling or transporting. Preferably, the pad 24 is made of dense foam, permanently fixed to the first panel 12 on one side and treated with removable adhesive on the other side facing the DVD 16. However, the pad 24 may be made from any other suitable material. Alternatively, as shown in dotted lines in FIG. 2, a post 23 including flexible arms may be provided on the rear panel to hold the DVD, similar to conventional plastic DVD or CD cases.

The adhesive attaching the DVD 16 may also allow reattaching the DVD 16 back onto the first panel 12 after playing the DVD. Other suitable means, such as tabs, tape, pockets, panel slit openings, envelopes, clips, etc., may also be used to removably attach the DVD 16 to the first panel 12.

Figure 7:
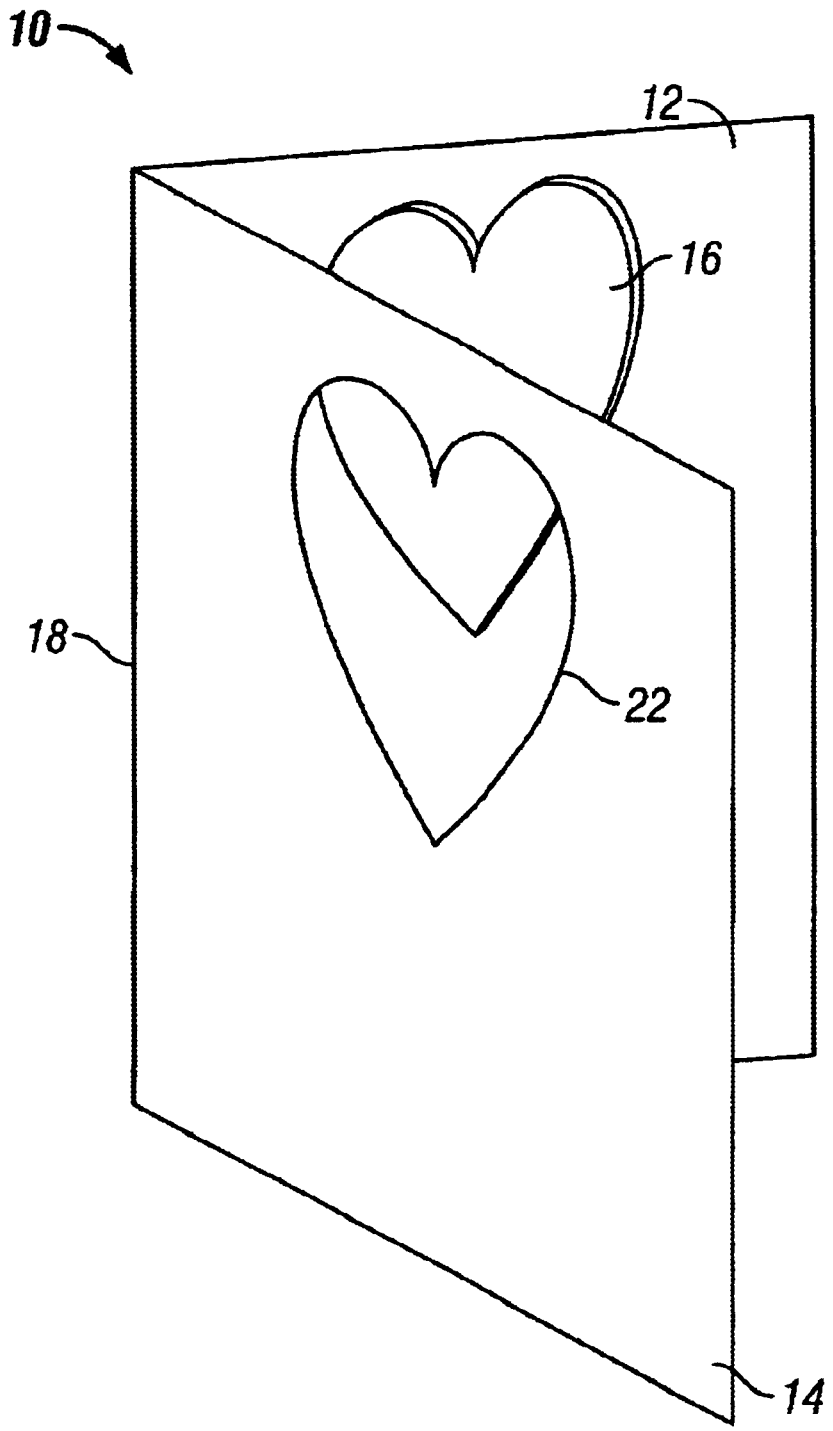
FIG. 7 is a perspective view of a greeting card with a heart-shaped cutout and a heart-shaped DVD attached to the greeting card.

The DVD 16 is preferably circular. However, the DVD may be other shapes, such as, for example oval or heart-shaped, as shown in FIG. 7. The shape may be selected as appropriate for the theme of the greeting card.

The DVD 16 contains audio and/or video recordings. The audio and/or video recordings contained in the DVD 16 provides a quality multi-media experience to the recipient.

The greeting card recipient experiences a feeling, much like the excitement of anticipation just prior to opening a greeting card, while removing the DVD 16 and playing it in a DVD. The greeting card sender may express personal thoughts through personal notes written on the greeting card 10 panels and through the selection of an appropriate audio and/or video recording on the DVD 16. In this way, the recipient advantageously benefits from the personal touch of the written note as well as the full sound and visual effects provided through the disc player.

The content of the DVD is selected based on the theme of the card. For example, for a Valentines Day card, the audio and/or video recordings contained in the DVD 16 may include a montage of romantic movie moments accompanied by an operatic music. The video recordings may feature classic romantic movie scenes including scenes from famous films, such as Gone With The Wind, Casablanca, City Lights, or Singing in the Rain. Advantageously, the selection of video recordings contained in digital disc 16 provides an emotionally stirring experience to the greeting card 10 recipient.

The DVD 16 is preferably a miniature DVD, having a diameter or largest characteristic dimension of 1–4 inches, or 1½–3½ inches, or 2–3 inches. In the embodiment shown, the DVD is about 2¾ inches in diameter. If the DVD is not round, the largest characteristic dimension is the longest dimension between any two locations on the DVD. The central area of the disk may have a label 27 and the rest of the disk may have embedded text or images. The disk may alternatively be attached to the front panel, or a single panel card may also be used.

Referring to FIGS. 1 and 2, the second panel 14 includes a cutout 22. Preferably, the cutout 22 is arranged on the second panel 14 such that the DVD 16 that is removably attached to the first panel 12 is at least partially visible when the greeting card 10 is closed. The first panel 12 preferably has no cutout. Preferably, the cutout 22 on the second panel 14 is a circle and is sufficiently sized to facilitate complete viewing of the DVD 16 when the greeting card 10 is closed as best illustrated in FIG. 2. Although a circular cutout 22 is shown in FIG. 1, the cutout 22 may have other shapes and sizes suitably positioned to at least partially view the DVD 16, such as the heart-shaped cutout shown in FIG. 7.

In a preferred embodiment, the greeting card 10 includes a digital disc 16 removably attached to a pad 24 and a cutout 22 larger than the DVD 16. When the greeting card 10 is closed, the DVD 16 may at least partially protrude through the cutout 22. This adds aesthetic appeal by, for example, providing a three-dimensional effect to an otherwise two-dimensional greeting card. Further, this facilitates removal and reattachment of the DVD 16 while the card is opened and closed. The digital disc 16 on the pad 24 eases the removal and reattachment process because the edges of the digital disc 16 are spaced apart from the first panel 12. By using an adhesive that facilitates reattachment of the disc 16, the greeting card 10 may further serve as convenient storage for the disc 16 as the greeting card 10 is displayed in the recipient's home or office.

Figure 6:
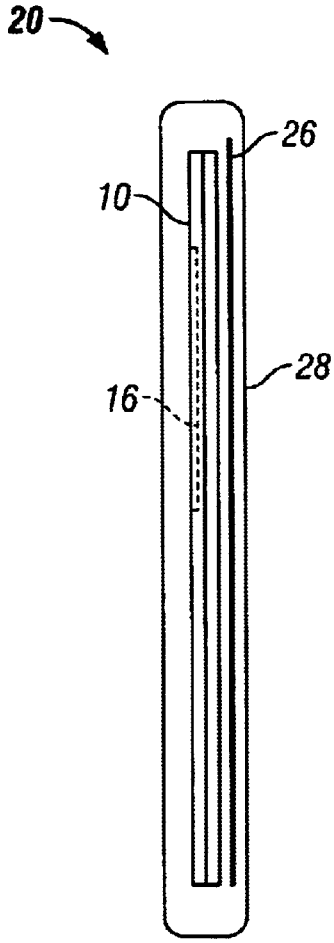
FIG. 6 is a side view of the present greeting card system.

Turning to FIG. 6, in a separate aspect, a greeting card package 20 includes the greeting card 10 stacked on an envelope 26 and packaged in a clear sleeve 28 for purposes of, for example, sales or storage prior to sale. The envelope 26 is sized to receive the greeting card 10 in the closed position and may be used to send the greeting card 10 or for general presentation purposes when exchanging greeting cards. The sleeve 28 surrounds the greeting card 10 and envelope 26 and is sealed by adhesive or tape or other suitable sealing means.

Various printed text or images may be placed on the first panel 12, the second panel 14, and the DVD 16, and various audio and/or video recordings may be contained in the DVD 16. Both the printed content and the DVD content can be personalized, via PC printing and DVD burning techniques. Packaging in the sleeve 28 as described provides protection to the digital disc 16 while allowing the consumer to view the entire greeting card 10.

Thus, a novel greeting card and greeting card system has been shown and described. Various changes can, of course, be made without departing from the spirit and scope of the invention. The invention, therefore, should not be restricted, except to the following claims and their equivalents.

What is claimed is:

1. A greeting card comprising:

a first panel;

a second panel foldably connected to an edge of the first panel; and a miniature digital disc removably attached to the first panel.

2. The greeting card of claim 1 wherein the first panel and the second panel are substantially equal in dimension.

3. The greeting card of claim 1 wherein the digital disc is attached to the first panel by an adhesive.

4. The greeting card of claim 1 wherein the digital disc is attached to the first panel on a post.

5. The greeting card of claim 1 wherein the digital disc is circular.

6. The greeting card of claim 1 wherein the digital disc is heart-shaped.

7. The greeting card of claim 1 with the second panel including a cutout to view at least a part of the digital disc.

8. The greeting card of claim 7 wherein the cutout is circular.

9. The greeting card of claim 7 wherein the cutout is heart-shaped.

10. The greeting card of claim 7 further including a pad fixed to the first panel, with the video disc removably attached to the pad such that the video disc protrudes at least partially through the cutout.

11. A greeting card comprising:

a first panel, a miniature video disc removably attached to the first panel, the video disc containing a montage of video scenes; and a second panel foldably connected to the first panel at an edge, the second panel including a cutout to at least partially view the video disc.

12. The greeting card of claim 11 further including a pad fixed to the first panel, the video disc removably attached to the pad such that the video disc protrudes at least partially through the cutout.

13. The greeting card system comprising:

a greeting card including a first panel, a video disc removably attached to the first panel, and a second panel foldably connected to the first panel at an edge;

an envelope sized to contain the greeting card; and a cellophane sleeve containing the greeting card and the envelope, wherein the video disc attached to the first panel is at least partially visible.

14. The greeting card system of claim 13 wherein the second panel including a cutout, the video disc attached to the first panel at least partially visible through the cutout and the cellophane sleeve.

15. The greeting card system of claim 13 wherein the second panel including a cutout, the video disc removably attached to the first panel at least partially protruding through the cutout, the video disc visible through the cutout and the cellophane sleeve.

16. A greeting card comprising:

a first panel, a miniature video disc removably attached to the first panel, the video disc containing a montage of video scenes; and a second panel foldably connected to the first panel at an edge, the second panel including a cutout that is larger than the video disc to view the complete video disc.

17. A greeting card comprising:

a first panel, a miniature video disc removably attached to the first panel, the video disc containing a montage of video scenes; and a second panel foldably connected to the first panel at an edge, the second panel including a cutout to at least partially view the video disc, wherein the video disc at least partially protrudes through the cutout.

18. A greeting card comprising:

a first panel, a miniature video disc removably attached to the first panel, the video disc containing a montage of video scenes; and a second panel foldably connected to the first panel at an edge, the second panel including a cutout to at least partially view the video disc, wherein the video disc is removable through the cutout.

* * * * *